US010759216B1

(12) United States Patent
Liu et al.

(10) Patent No.: US 10,759,216 B1
(45) Date of Patent: Sep. 1, 2020

(54) ADJUSTABLE RING AND RING BINDERS USING THE SAME

(71) Applicants: Stanley YiFei Liu, Warren, NJ (US); Wesley YiMing Liu, Warren, NJ (US); Zhiqiang Liu, Warren, NJ (US); Genshen Liu, Niskayuna, NY (US)

(72) Inventors: Stanley YiFei Liu, Warren, NJ (US); Wesley YiMing Liu, Warren, NJ (US); Zhiqiang Liu, Warren, NJ (US); Genshen Liu, Niskayuna, NY (US)

( * ) Notice: Subject to any disclaimer, the term of this patent is extended or adjusted under 35 U.S.C. 154(b) by 0 days.

(21) Appl. No.: 16/792,289

(22) Filed: Feb. 16, 2020

(51) Int. Cl.

| | |
|---|---|
| ***B42F 13/30*** | (2006.01) |
| ***B42F 13/26*** | (2006.01) |
| ***B42F 13/32*** | (2006.01) |
| ***B42F 13/34*** | (2006.01) |

(52) U.S. Cl.
CPC ..... *B42F 13/26* (2013.01); *B42F 13/30* (2013.01); *B42F 13/32* (2013.01); *B42F 13/34* (2013.01)

(58) Field of Classification Search
CPC ..... B42F 13/30–34
USPC ..... 402/48, 50, 52, 54, 56
See application file for complete search history.

(56) References Cited

U.S. PATENT DOCUMENTS

| | | | | | |
|---|---|---|---|---|---|
| 917,773 | A * | 4/1909 | Leach | B42F 13/28 | 402/48 |
| 2,099,472 | A * | 11/1937 | Emery | B42F 13/16 | 402/58 |
| 2,163,856 | A * | 6/1939 | Schade | B42F 13/408 | 402/39 |
| 2,855,935 | A * | 10/1958 | Ham | B42F 13/16 | 402/28 |
| 4,172,675 | A * | 10/1979 | Lacourt | B42F 13/16 | 402/48 |
| 2003/0170074 | A1* | 9/2003 | Mills | F16D 1/06 | 403/324 |
| 2008/0095572 | A1* | 4/2008 | Frankeny | B42F 13/24 | 402/38 |

FOREIGN PATENT DOCUMENTS

| | | | | | |
|---|---|---|---|---|---|
| FR | 783954 | A * | 7/1935 | B42F 13/30 | |
| GB | 214276 | A * | 2/1925 | B42F 13/00 | |

* cited by examiner

*Primary Examiner* — Kyle R Grabowski

(57) ABSTRACT

An adjustable ring having a curved section and two telescoping arms. Each telescoping arm comprises two or more tubes that move relative to each other in a concentric manner between a collapsed state and an extended state to accommodate various amounts of sheet or sheet-like materials. A ring binder can be constructed using one or more of the adjustable rings.

5 Claims, 14 Drawing Sheets

ADJUSTABLE RING AND RING BINDERS USING THE SAME

FIELD OF THE INVENTION

The invention relates generally to improved rings and binders using such improved rings. More particularly, the invention relates to adjustable rings, which provide customized capacity for loose-leaf sheets and sheet-like materials, and binders using the same.

DESCRIPTION OF THE RELATED ART

Various types of ring binders with rings of fixed capacity have been developed to hold loose-leaf sheet or sheet-like materials. For example, paper, boards, slides, transparencies, photographs, plastic holders for disks, and business cards may be stored in ring binders. The binders come in various sizes, shapes, and configurations.

As exemplified in FIG. 1, a simple binder 1 comprises four main parts: one or more rings 2, a front cover 3, a rear cover 4, and a spine 5. The spine 5 serves to connect the front and rear covers. One or more rings 2 are fastened to the rear cover 4, adjacent to the spine 5. The front cover 3 and the rear cover 4 can rotate relative to each other so that the binder can alternate between a fully closed position (shown in FIG. 1) and a fully open position. When the binder is in the fully closed position, the end portion of the front cover 3 that is nearest the spine 5 (the proximal end portion) rests on top of the one or more rings 2, and the end portion of the front cover 3 that is farthest from the spine 5 (the distal end portion) tapers down to meet the distal end portion of the rear cover 4.

Conventional designs of rings are fixed in capacity and size. When more capacity is desired, the user must transfer all the material to a new binder with a larger ring to increase the capacity. When less capacity is desired, the user also must transfer all the material to a new binder with a smaller ring to avoid leaving a significant amount of empty space in the binder.

Having a binder with an adjustable ring would appeal to many users because the entire binder can be utilized in many different size configurations with improved convenience and efficiency. Therefore, there exists a need for a binder, with one or more adjustable rings, that can conform to different amounts of material.

BRIEF DESCRIPTION OF THE INVENTION

The invention is directed to an adjustable ring, and a binder containing one or more of such adjustable rings.

According to a first embodiment of the invention, an adjustable ring in accordance with the present invention is an upside-down U-shaped ring comprising a pair of telescoping arms with a curved section placed on top of, and connected to, each telescoping arm. Each curved section has a proximal end for connecting to the top of the corresponding telescoping arm, and a distal end for facing and releasably connecting with the distal end of the other curved section. The telescoping arms either share a ground plate, or each is attached to a separate ground plate. The ground plate(s) attach the ring to a backing material of a binder.

In additional embodiments of the invention, an adjustable ring is provided according to the first embodiment, wherein the telescoping arm on each side of the ring is replaced by a telescoping structure that is known in the art, such as ones described in U.S. Pat. No. 2,298,140 titled "Telescopic Extensible Antenna," U.S. Pat. No. 5,164,739 titled "Antenna Device for an Automobile," or U.S. Pat. No. 6,830,552 titled "Backscratcher with a Telescopically Adjustable Shaft and with a Plurality of Screw-on Attachment End Pieces." The disclosure of these three patents is incorporated in this application in their entirety.

In additional embodiments of the invention, a binder constructed in accordance with the present invention comprises a front cover, a rear cover, a spine connecting the both covers, and one or more adjustable rings attached to the rear cover. Other binder constructions can be used in conjunction with one or more of the adjustable rings of the invention, such as the binder designs described in U.S. Pat. No. 5,607,246, the entirety of which is incorporated in this application.

BRIEF DESCRIPTION OF THE DRAWINGS

The invention will be understood more readily from the following detailed description of the invention, when taken in conjunction with the accompanying drawings.

DETAILED DESCRIPTION OF THE INVENTION

The invention is explained in connection with the following exemplary embodiments. They are provided as examples to facilitate the description of the invention and should not be regarded as exclusive embodiments. As discussed below, multiple variations can be made to the design of the ring binder without departing from the spirit or scope of the invention.

The adjustable ring 10 in accordance with the first embodiment of the invention is illustrated in FIGS. 2-12.

Figure 1:
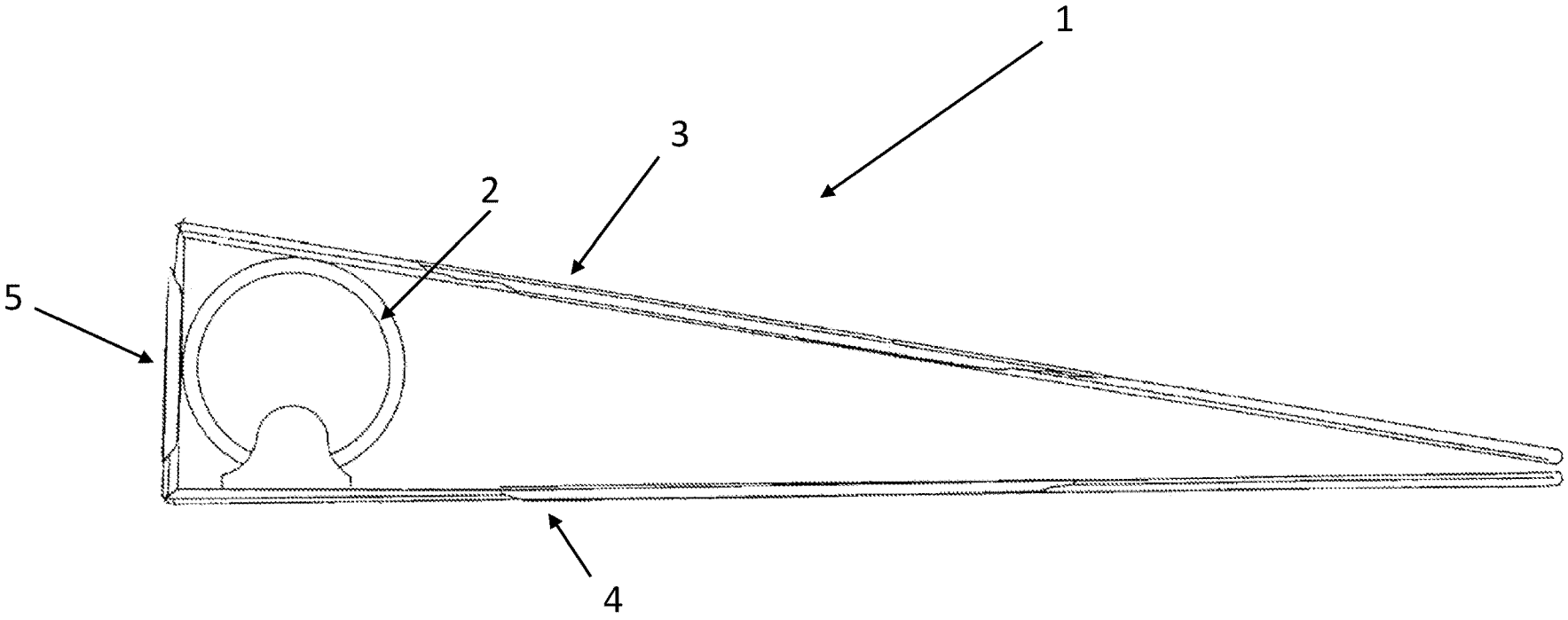
FIG. 1 is a side view of a binder having one or more rings of conventional designs.
Figure 2:
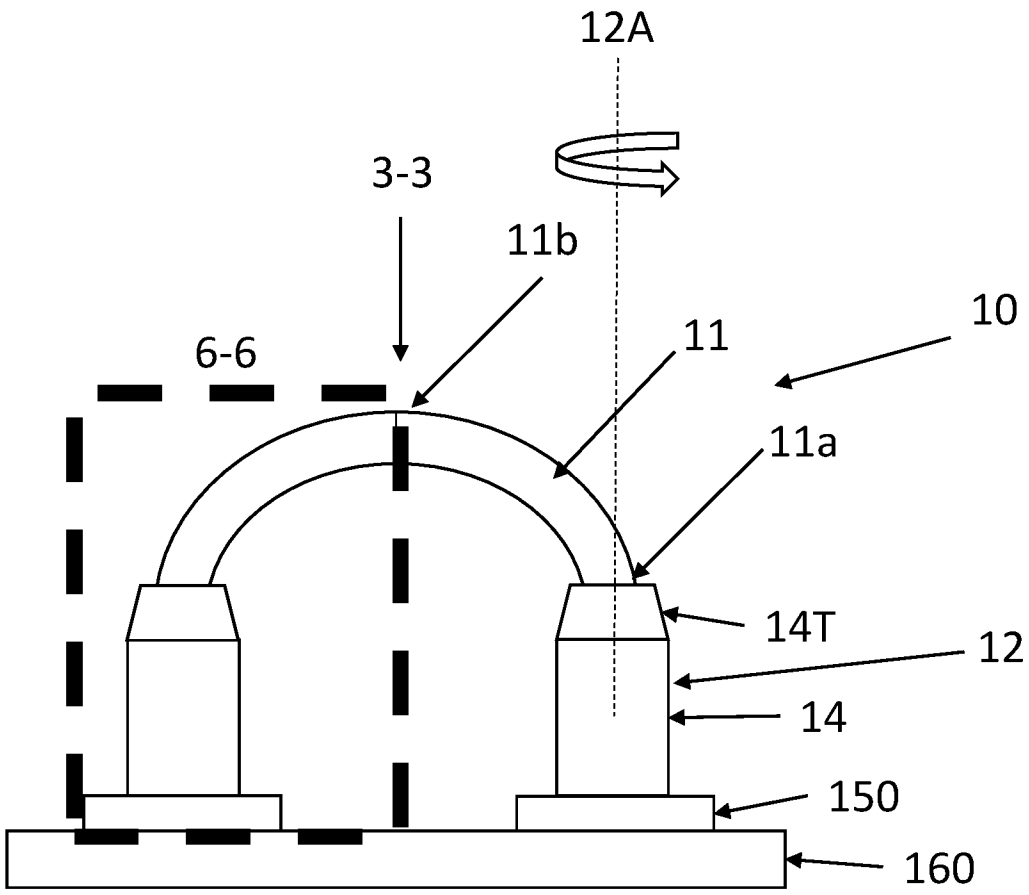
FIG. 2 is a front view of an adjustable ring in accordance with a first embodiment of the invention, wherein the ring is in a fully collapsed state.

FIG. 2 shows an adjustable ring 10 in a fully collapsed state. Each adjustable ring 10 is generally in an upside-down U configuration, and comprises a pair of curved sections 11, and a pair of telescoping tube assemblies 12. The pair of curved sections 11 and the pair of telescoping tube assemblies 12 are arranged as symmetrical halves, wherein each half comprises a curved section 11 placed on top of, and connected to, the top of a telescoping tube assembly 12. In FIG. 2, the left half is encased in dotted rectangle 6-6 for purposes of indicating a cross-sectional view in FIG. 6. The symmetrical halves have identical structures arranged as mirror image relative to one another. Each combination of curved section 11 and telescoping tube assembly 12 can have its own base plate 150, or both combinations can share a single base plate 150.

The curved section 11 preferably has a circular cross section, although other cross sections, such as an oval, a rectangle or a square, are contemplated. The curved section 11 has a proximal end 11*a* and a distal end 11*b*. The proximal end 11*a* of each curved section 11 is attached to the top of the corresponding telescoping tube assembly 12. The distal ends 11*b* of both curved sections 11 are arranged to face each other with a releasable connection. The curved section 11 can be made as a solid piece, or hollow inside.

Figure 3:
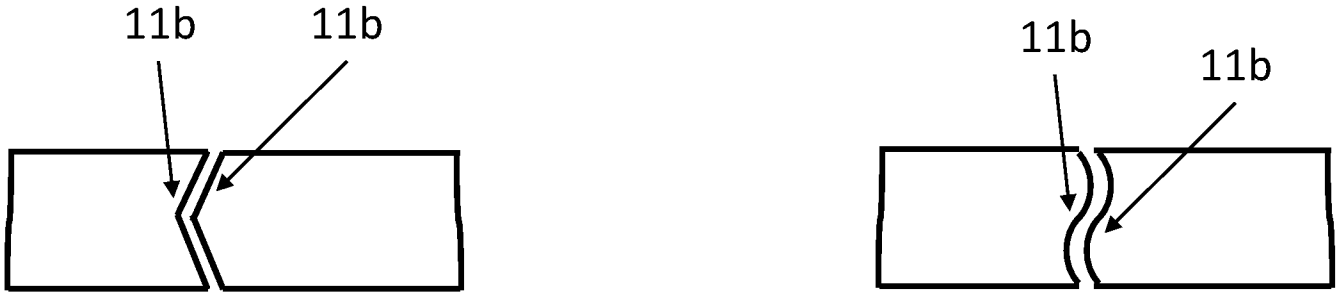
FIG. 3 is a top view of the distal ends of the curved sections 11 in accordance with the first embodiment of the invention, wherein the adjustable ring is in a fully collapsed state.

The releasable connection is intended to prevent or minimize unwanted motions with the adjustable ring. One unwanted motion is the rotational motion in which the curved section 11 rotates in one or the other direction about the axis 12A of the telescoping tube assembly 12, causing the distal end 11*b* of the curved section 11 to move out of or into the two-dimensional plane in FIG. 2. The releasable connection can be achieved using any means in which the opposing surfaces of the distal ends 11*b* of both curved sections 11 can interact with each other in a non-permanent fashion. For example, one of the opposing surfaces of the distal ends 11*b* has a magnetic material, and the other opposing surface has a paramagnetic material (e.g., iron, nickel, cobalt, gadolinium, dysprosium and alloys such as steel that also contain specific ferromagnetic metals such as iron or nickel). Alternatively, the opposing surfaces of the distal ends 11*b* can both have magnetic materials with opposite polarities facing each other. As an alternative to, or in addition to using magnetism, the opposing surfaces of the distal ends 11*b* can have uneven surfaces with matching features that effectively lock with each other to prevent unwanted motions, such as those described in FIG. 3. In FIG. 3, gaps are shown between the surfaces of the distal ends 11*b* to better illustrate the surface features. In reality, when the distal ends 11*b* are releasably connected, there are minimal or no gaps between the opposing surfaces of the distal ends 11*b*.

For clarity, the surfaces of the distal ends 11*b* are present as complimentary surfaces to prevent unwanted motion about the axis 12A described in FIG. 2, but the surfaces of the distal ends do not prevent vertical motion, which would subsequently prevent the extending and collapsing of the adjustable rings. As a solution to unwanted vertical motion between the curved sections 11, the surfaces of the distal ends 11*b* may have magnetic materials, as described above.

The telescoping tube assembly 12 has two or more tubes configured in a telescoping relationship so that the telescoping tube assembly 12 can extend or collapse in length as needed. The telescoping tube assembly 12 preferably has a circular cross section, although other cross sections, such as an oval, a rectangle or a square, are contemplated.

In the fully collapsed state, only the outermost tube (14) of the telescoping tube assembly 12 is visible. The top of the outermost tube 14 ends in an edge 14T, which preferably tapers in the direction toward the curved section 11. The bottom of the outermost tube 14 is connected to a base plate 150, which in turn is connected to a ground plate 160.

Figure 4:
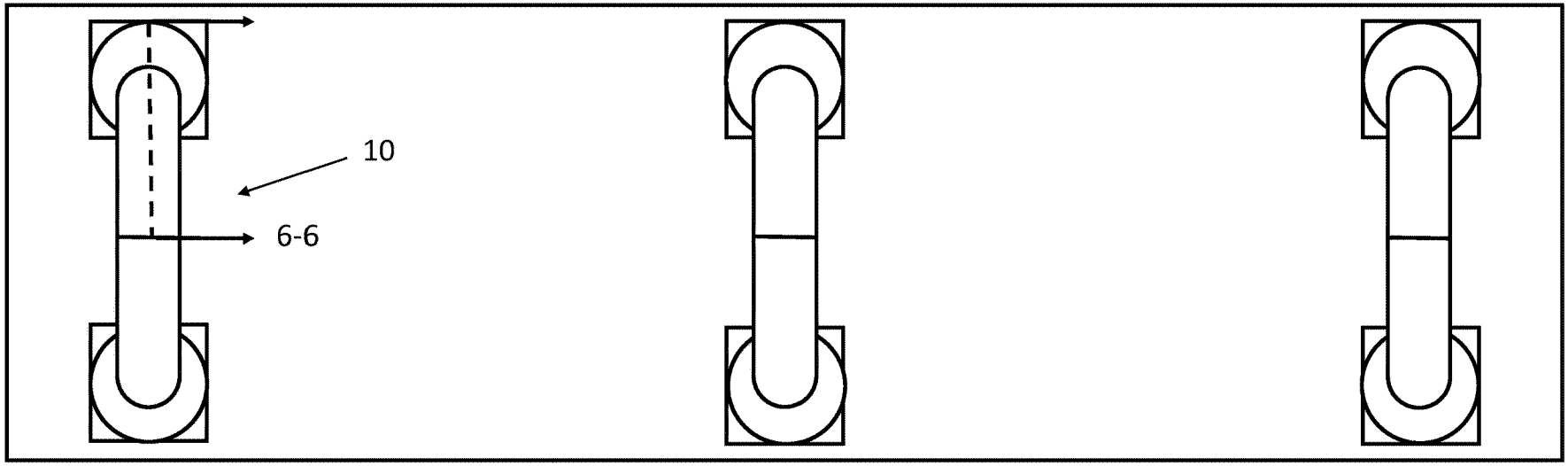
FIG. 4 is a top view of an assembly of three adjustable rings in accordance with the first embodiment of the invention, wherein the rings are in a fully collapsed state, and are installed parallel to each other on to a backing material (e.g., the proximal end portion of the rear cover).

FIG. 4 is a top view of three adjustable rings 10 situated parallel to each other to hold three-hole punched materials. In an alternative design, only two adjustable rings 10 are provided so that the binder can contain two-hole punched materials. Other number of adjustable rings 10, such as one, three, or more, can be used in additional alternative designs. Preferably, adjustable rings 10 are in equal distance from each other.

Figure 5:
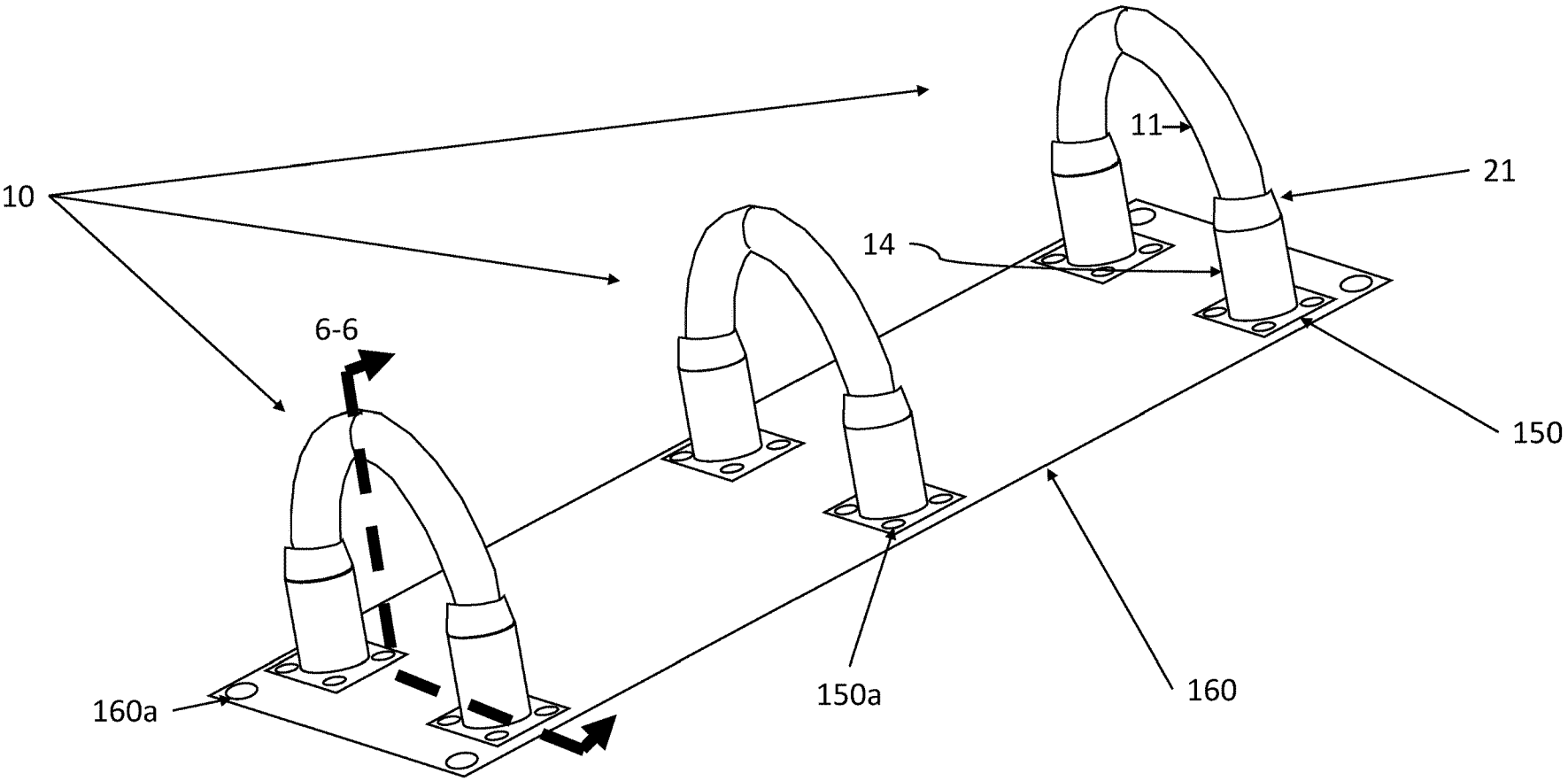
FIG. 5 is a perspective view of an assemblies of three adjustable rings in accordance with the first embodiment of the invention, wherein the rings are in a fully collapsed state.

FIG. 5 is a perspective view of the design shown in FIG. 4 including additional details that were omitted in FIG. 4 for simplicity. FIG. 5 shows a base plate 150 under, and connected to, each outermost tube 14 with one or more (four shown in FIG. 5 as an example) elements 150*a* for connecting the base plate 150 to a ground plate 160. Element 150*a* is an opening in the base plate 150 that can receive a rivet or other fastener. The ground plate 160 has one or more (four shown in FIG. 5 as an example) elements 160*a* for connecting the ground plate 160 to the rear cover of a binder. Element 160*a* is an opening in the ground plate 160 that can receive a rivet or other fastener. The ground plate 160 is optional, because the base plate 150 can be directly attached to the rear cover.

Figure 6:
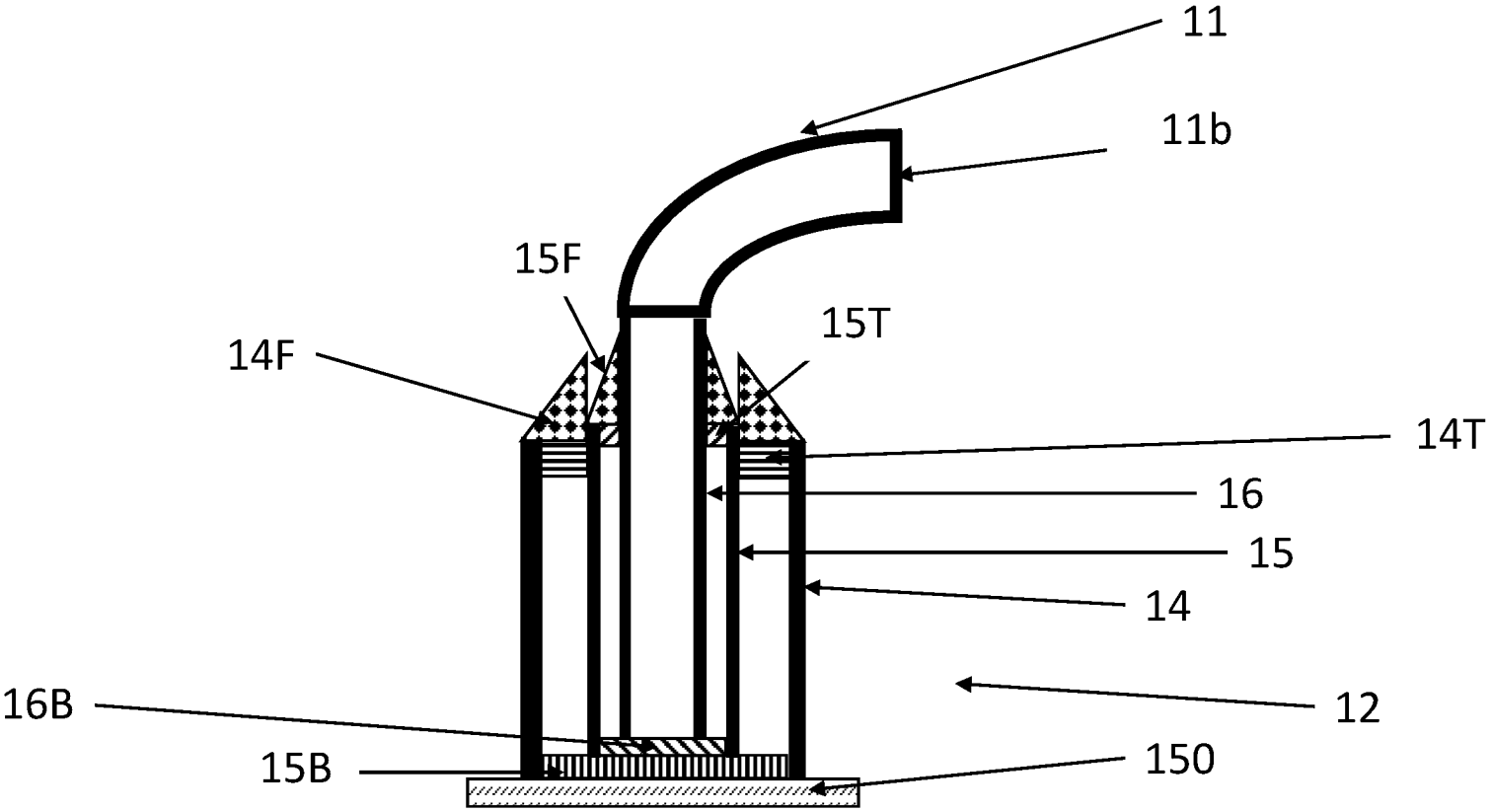
FIG. 6 is a cross-sectional view of one symmetrical half of the adjustable ring along the direction of 6-6 in FIGS. 2, 4 and 5 in accordance with the first embodiment of the invention.

FIG. 6 illustrates the cross-sectional view of a curved section 11, telescoping tube assembly 12 and a base plate 150, wherein the cross section is taken along the line 6-6 in FIGS. 2, 4 and 5. In FIG. 6, the telescoping assembly 12 comprises three tubes (14, 15 and 16) in a telescoping arrangement. Of course, a telescoping assembly with two tubes, or four or more tubes are contemplated as well.

All tubes in the telescoping tube assembly 12 have the same cross-sectional shape, which is preferably a circle, although other cross sections, such as an oval, a rectangle or a square, are contemplated. The tubes are preferably coaxial, meaning that they share the same central axis.

The tubes are designed to have increasing diameters (or an appropriate cross-sectional dimension in the event that the tubes do not have a circular cross section) going from inside to outside in a radial manner. For example, in FIG. 6, the innermost tube 16 is located within the intermediate tube 15, which in turn is located in the outermost tube 14. The diameters increase in going from tube 16, to tube 15, and finally to tube 14.

However, if desired, the tubes that construct a telescoping tube assembly 12 may have tubes that have decreasing diameters (or an appropriate cross-sectional dimension in the event that the tubes do not have a circular cross section) going from inside to outside in a radial manner. This design incorporates the same auxiliary features as the described adjustable rings, such as the edges 14F and 15F, except they are oriented in such a fashion that they provide the similar effect of stabilizing a difference in diameters (which is explained in further detail below). This design effectively flips the telescoping tube assembly 12 in FIG. 6 upside down, and has the proximal end of the curved section 11 connected to the outermost tube 14.

The curved section 11 is attached to the top of the innermost tube, which in the case of FIG. 6, is the innermost tube 16. The curved section 11 and the innermost tube 16 can be made into a unitary structure. The curved section 11 preferably has the same diameter with the innermost tube 16, although differing dimensions can be used.

The tubes are designed so that they can glide along the central axis 12A in relation to each other between a fully extended state and a fully collapsed state. Stopping members are provided to prevent the tubes from extending beyond the fully extended state so that the tubes do not become disengaged from each other.

The stopping members for preventing the outermost tube 14 from disengaging from the intermediate tube 15 are a combination of lips 14T and 15B. The lip 14T originates from the inside surface of the outermost tube 14 at its top, and extends radially inward toward, and eventually abuts, the outside surface of the intermediate tube 15. The lip 14T is in the form of a plate with a hole in its center, wherein the hole matches the outside circumference of the intermediate tube 15, and the outer perimeter of the lip 14T matches the inside circumference of the outermost tube 14. The lip 14T can also have material that extends in a longitudinal manner of the telescoping tube assembly 12 (i.e., along the central axis 12A), imparting a thickness to the plate. In one case, the lip 15B originates from the outside surface of the intermediate tube 15 at its bottom, and extends radially outward toward, and eventually abuts, the inside surface of the outermost tube 14. In this case, the lip 15B is in the form of a plate with a hole in its center, wherein the hole matches the outside circumference of the intermediate tube 15, and the outer perimeter of the lip 15B matches the inside circumference of the outermost tube 14. In another case, the lip 15B can be a plate without a hole, which runs across the entire inside diameter of the outermost tube 14 and attached, at its top surface, to the bottom of the intermediate tube 15. In either case, the lip 15B can also have material that extends in a longitudinal manner of the telescoping tube assembly 12 (i.e., along the central axis 12A), imparting a thickness to the plate.

In a similar fashion, the stopping members for preventing the intermediate tube 15 from disengaging from the innermost tube 16 are a combination of lips 15T and 16B. The lip 15T originates from the inside surface of the intermediate tube 15 at its top, and extends radially inward toward, and eventually abuts, the outside surface of the innermost tube 16. The lip 15T is in the form of a plate with a hole in its center, wherein the hole matches the outside circumference of the innermost tube 16, and the outer perimeter of the lip 15T matches the inner circumference of the intermediate tube 15. The lip 15T can also have material that extends in a longitudinal manner of the telescoping tube assembly 12 (i.e., along the central axis 12A), imparting a thickness to the plate. In one case, the lip 16B originates from the outside surface of the innermost tube 16 at its bottom, and extends radially outward toward, and eventually abuts, the inside surface of the intermediate tube 15. In this case, the lip 16B is in the form of a plate with a hole in its center, wherein the hole matches the outside circumference of the innermost tube 16, and the outer perimeter of the lip 16B matches the inside circumference of the intermediate tube 15. In another case, the lip 16B can be a plate without a hole, which runs across the entire inside diameter of the intermediate tube 15 and attached, at its top surface, to the bottom of the innermost tube 16. In either case, the lip 16B can also have material that extends in a longitudinal manner of the telescoping tube assembly (i.e., along the central axis 12A), imparting a thickness to the plate.

As shown in FIG. 6, edges 14F and 15F are preferably provided to stabilize the telescoping tube assembly 12. Edge 14F is preferably provided as the top of the outermost tube 14. The edge 14F is preferably in the shape of a hollowed-out frustum, which has a constant inside diameter (or another cross-sectional dimension in the event that the outermost tube 14 is not cylindrical) and an outer diameter (or another cross-sectional dimension in the event that the outermost tube 14 is not cylindrical) that tapers as the edge 14F extends upward. Alternatively, the edge 14F can be a cylindrical structure so that there is no tapering on the outside. Other shapes can be used for the edge 14F, including one with a rounded top. In a like manner, an edge 15F is preferably provided as the top of the intermediate tube 15. Edge 14F provides additional surface for the outer surface of the intermediate tube 15 to engage with the outermost tube 14. Similarly, edge 15F provides additional surface for the outer surface of the innermost tube 16 to engage with the intermediate tube 15. Such engagement improves the stability of the telescoping tube assembly 12 by reducing flop or wobble. Such engagement also allows material placed on the rings to slide more easily from a smaller tube to a larger tube.

Lip 14T is fixedly attached to the inner surface of the outermost tube 14 and/or the under surface of the edge 14F. Similarly, lip 15T is fixedly attached to the inner surface of the intermediate tube 15 and/or the under surface of the edge 15F. Such fixed attachment can be in the form known in the art, such as through the use of a glue or an adhesive. Alternatively, lip 14T can be made as an appendage to, and an integral part of, the outermost tube 14. Similarly, lip 15T can be made as an appendage to, and an integral part of, the intermediate tube 15.

In a fully collapsed state, as shown in FIG. 6, the intermediate tube 15 reaches its lowest position with the lip 15B being close to or resting on the top surface of the ground plate 150. Similarly, the innermost tube 16 reaches its lowest position with the lip 16B being at its closest position toward (and possibly resting on) the lip 15B.

When the telescoping tube assembly 12 moves from a fully collapsed state toward a fully extended state, the lip 15B glides along the inner surface of the outermost tube 14, and/or the lip 16B glides along the inner surface of the intermediate tube 15.

Figure 7:
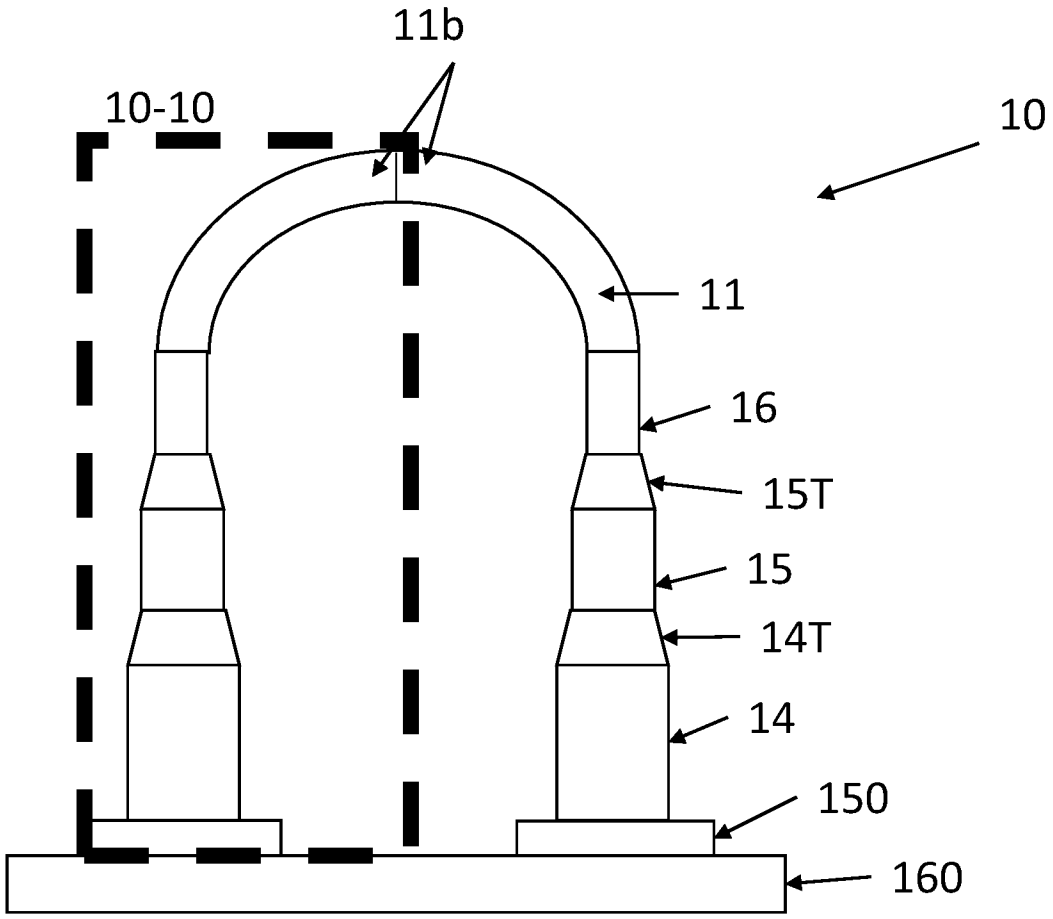
FIG. 7 is a front view of an adjustable ring in accordance with a first embodiment of the invention, wherein the adjustable ring is in a fully extended state.
Figure 8:
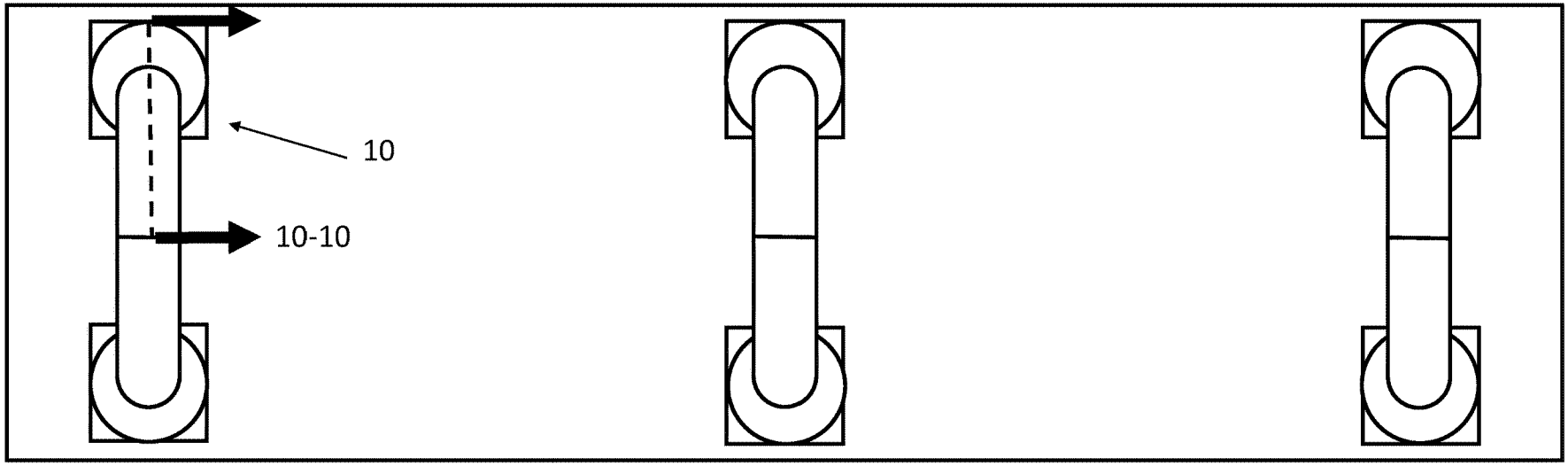
FIG. 8 is a top view of an assembly of three adjustable rings in accordance with the first embodiment of the invention, wherein the adjustable rings are in a fully extended state, and are installed parallel to each other on to a backing material (e.g., the proximal end portion of the rear cover).
Figure 9:
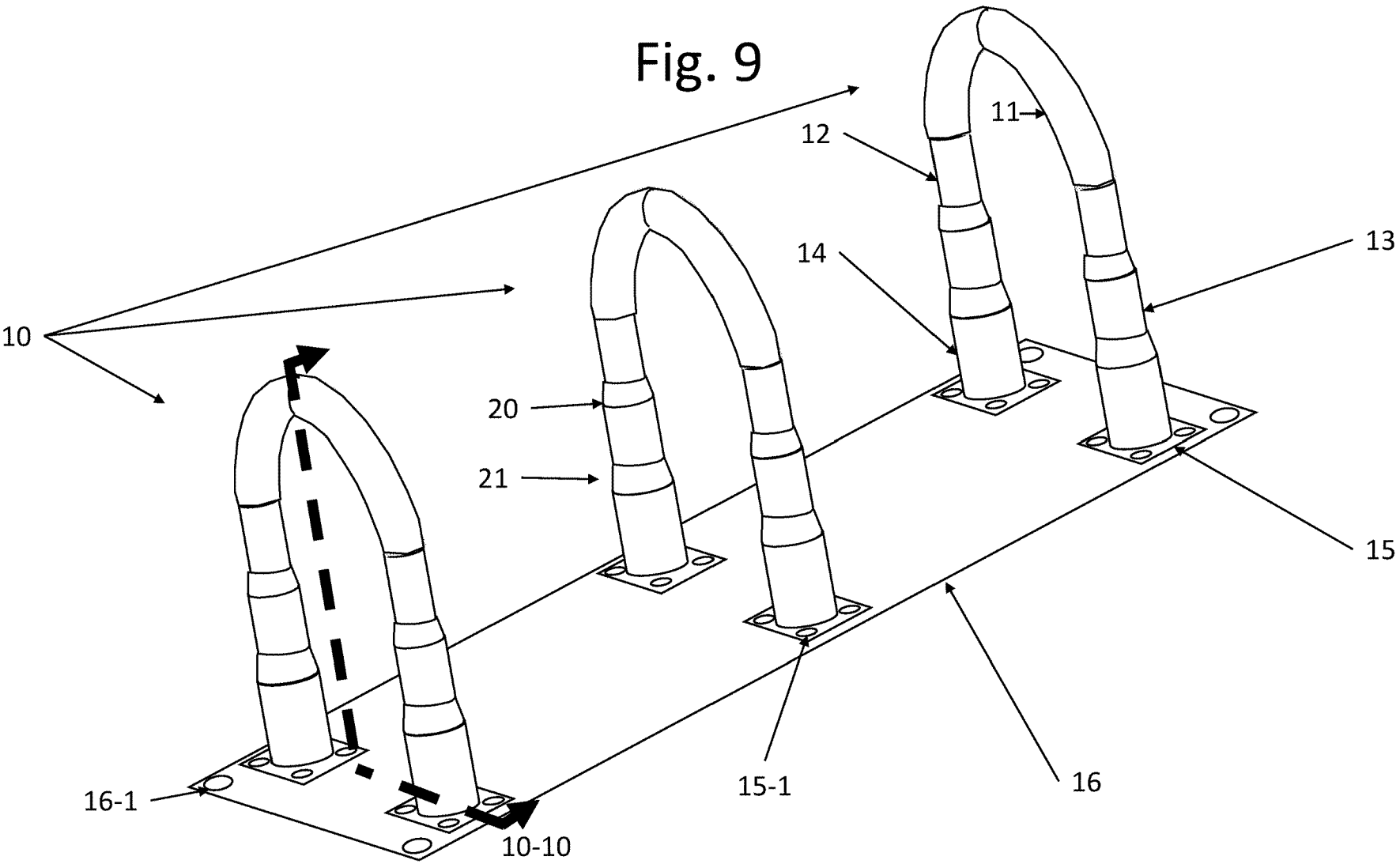
FIG. 9 is a perspective view of an assembly of three adjustable rings in accordance with the first embodiment of the invention, wherein the rings are in a fully extended state.

FIG. 7 is a front view of an adjustable ring 10 in a fully extended state. In the fully extended state, the intermediate tube 15 is above and sits on top of the outermost tube 14, and the innermost tube 16 is above and sits on top of the intermediate tube 15. FIGS. 8 and 9 are top and perspective views of three adjustable rings in a fully extended state, respectively.

Figure 10:
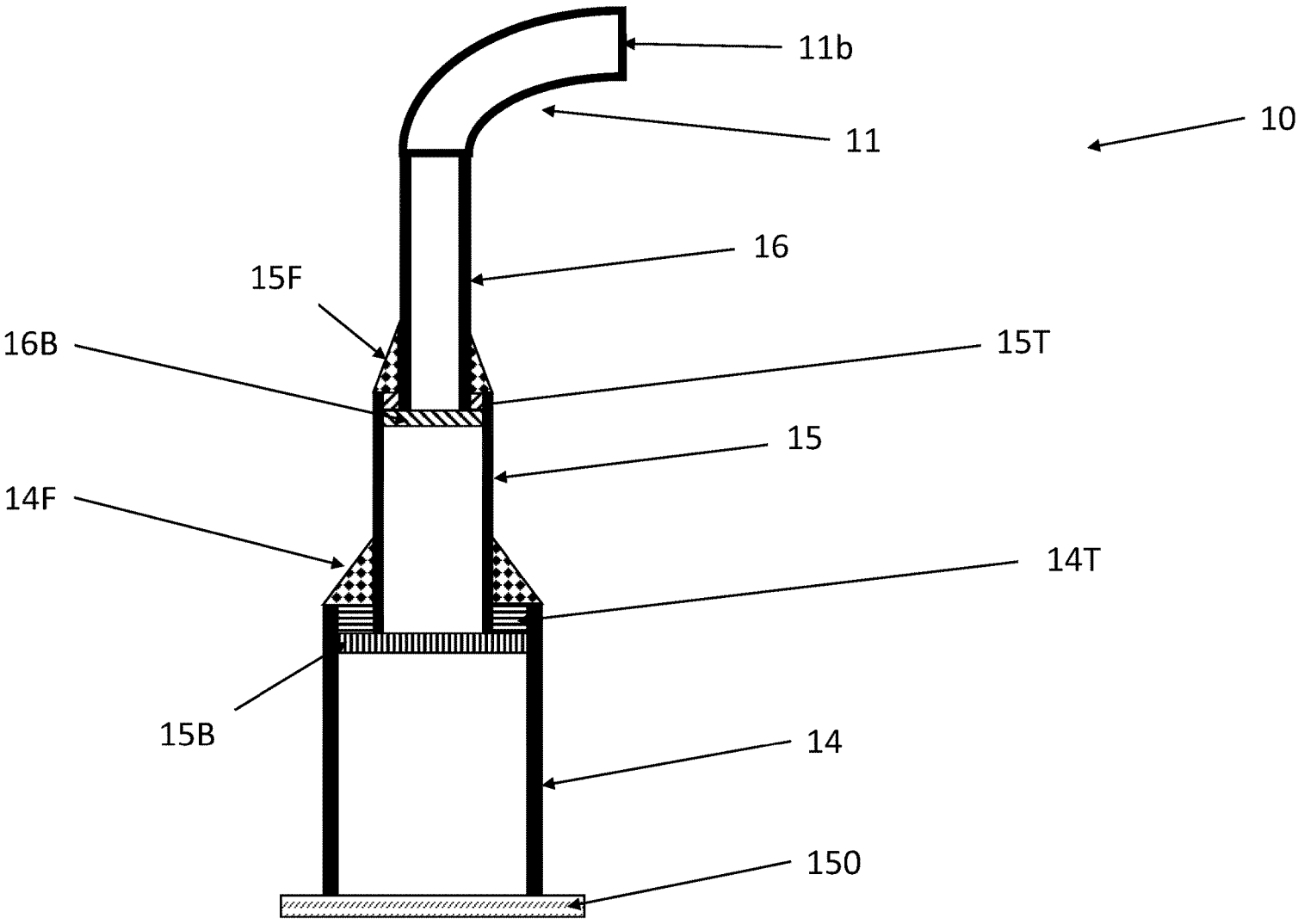
FIG. 10 is a cross-sectional view of one symmetrical half of the adjustable ring in a fully extended position along the direction of 10-10 in FIGS. 7, 8 and 9 in accordance with the first embodiment of the invention.
Figure 11:
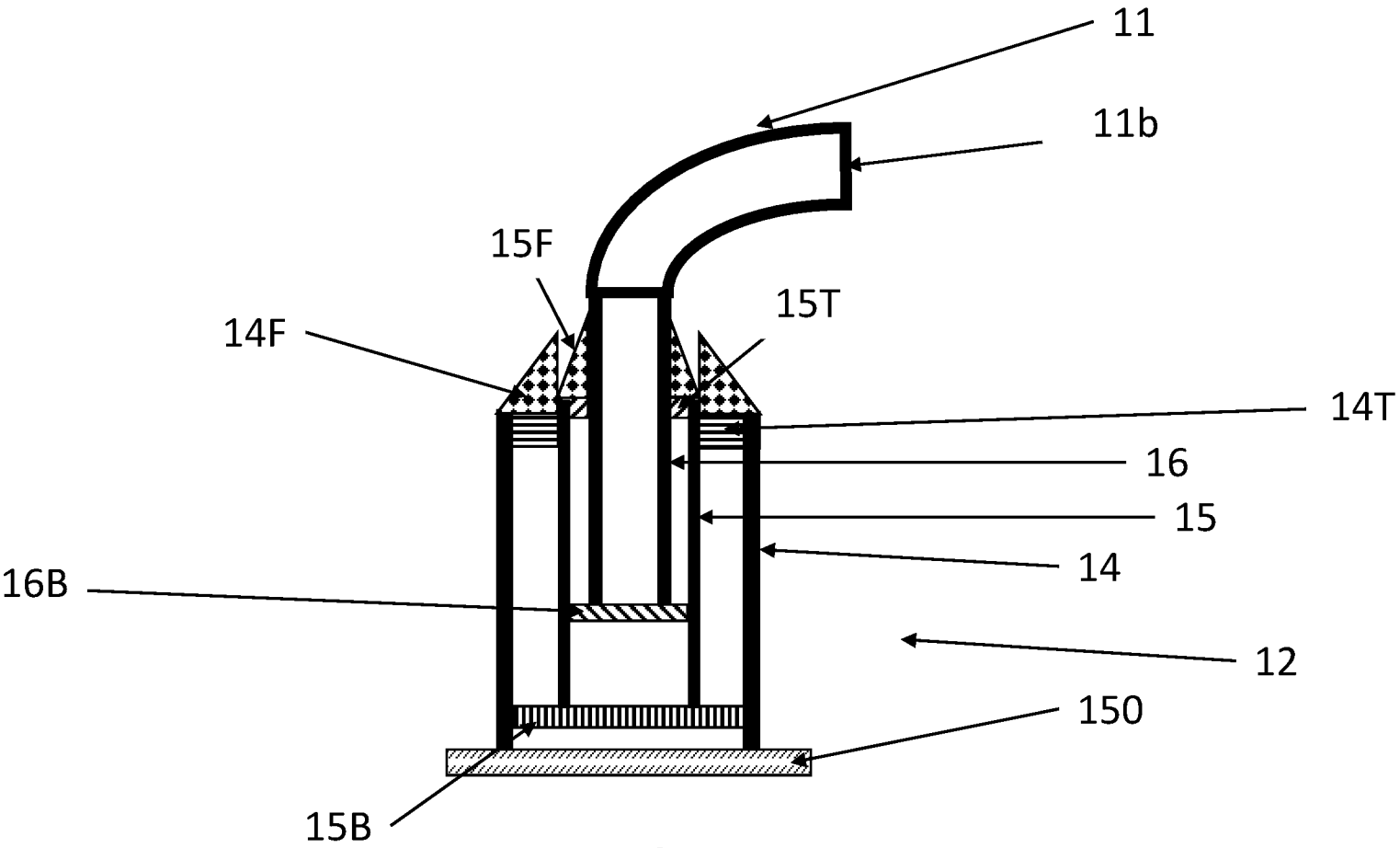
FIG. 11 is a cross-sectional view of one symmetrical half of the adjustable ring along the direction of 10-10 in FIGS. 7, 8 and 9 after moving the ring into an intermediate state.

FIG. 10 is a cross-sectional view of a curved section 11, telescoping tube assembly 12 and a base plate 150, in a fully extended state, wherein the cross section is taken along the line 10-10 in FIGS. 7-9. In FIG. 10, the intermediate tube 15 is extended to the uppermost position in relation to the outermost tube 14, at which point, the lip 15B engages with the lip 14T, preventing further upward movement of the intermediate tube 15. Similarly, the innermost tube 16 is extended to the uppermost position in relation to the intermediate tube 15, at which point, the lip 16B engages with the lip 15T preventing further upward movement of the innermost tube 16.

In addition to the fully collapsed state and the fully extended state, the telescoping tube assembly 12 can be in any number of intermediate states. In these intermediate states, such as the one illustrated in FIG. 11, the lip 15B of the intermediate tube 15, and/or the lip 16B of the innermost tube 16, are situated away from and in between the uppermost and lowermost positions. The capacity of the ring is determined by the degree of extension of the telescoping tube assembly 12.

The outermost tube 16 and any intermediate tube, such as 15 in the figures, should be hollow to accommodate internal structures. The innermost tube 16 and the curved section 11 can have a hollow inside or be made as a solid piece.

The tubes 14, 15 and 16 and the curved section 11 can be constructed of any suitable material, including, but not limited to, steel, iron, aluminum, copper, bronze, plastic, etc. The lips 14T, 15T, 15B and 16B can be made using any of the same materials in the preceding sentence, or other materials, such as an elastomeric material (e.g., rubber).

The adjustable ring 10 can be designed such that the tubes 14, 15 and 16 can move up and down in relation to each other with or without friction between two adjacent tubes.

If no friction between the parts of the tube assembly 12 is present, the capacity of the ring is determined by how much material is placed on the ring. The ring will collapse with the force of gravity until it reaches the lowest point, which is the top of material on the ring or the fully closed state, whichever is higher.

Friction allows the tubes to stay in an intermediate state on their own, which facilitates the insertion of papers into the binder. Without friction, the adjustable ring 10 will automatically collapse with the force of gravity to the most collapsed state that is permitted by existing material in the binder.

Various methods can be used to impart desirable friction between the tubes. In one method, the tubes and/or lips are dimensioned such that an inner part fits tightly within an outer part, creating friction through compressive forces between the mating surfaces of the parts. In another method, one or both of the mating surfaces (i.e., the inner surface of an outer tube and the outer surface of an inner lip) are provided with a coating or surface layer that imparts or adjusts friction. Examples of suitable coating includes a polymeric coating, such as those described in U.S. Pat. No. 3,893,496, which is incorporated in its entirety into the instant specification. Examples of suitable surface layer includes a rubber, a suede, or another material with a coarse surface. In yet another method, one or more lips (especially those made of rubber or another elastomeric material) can be dimensioned such that they are wider than the internal voids of the corresponding outer tubes when they are in their natural, uncompressed state, but can fit inside such internal voids under compression. The compression required to insert the lips into the corresponding outer tubes leads to the creation of friction between these parts.

Other known mechanisms can be provided to releasably lock two adjacent tubes in a specific position. For example, a ball retention mechanism as described in U.S. Patent Application Publication No. US20030170074 can be used to releasably lock the outermost tube 14 in relation to the intermediate tube 15, and/or the intermediate tube 15 in relation to the innermost tube 16. The disclosure of U.S. Patent Application Publication No. US20030170074 is incorporated in its entirety in the instant application. Such lock allows a user to add or remove materials to the ring without worrying about the telescoping arm(s) collapsing under the effect of gravity, and the lock can be readily broken once the addition or removal has been accomplished.

In additional embodiments, telescoping assemblies with known designs can be used for purposes of this invention. For example, in these additional embodiments, the telescoping arm 12 is replaced by a telescoping structure that is described in U.S. Pat. No. 2,298,140 titled "Telescopic Extensible Antenna," U.S. Pat. No. 5,164,739 titled "Antenna Device for an Automobile," or U.S. Pat. No. 6,830,552 titled "Backscratcher with a Telescopically Adjustable Shaft and with a Plurality of Screw-on Attachment End Pieces." The disclosure of these three patents is incorporated in this application in their entirety. The design illustrated in FIG. 5 of U.S. Pat. No. 6,830,552 is particularly advantageous because it reduces or eliminates the unwanted rotation between the tubes.

Figure 12:
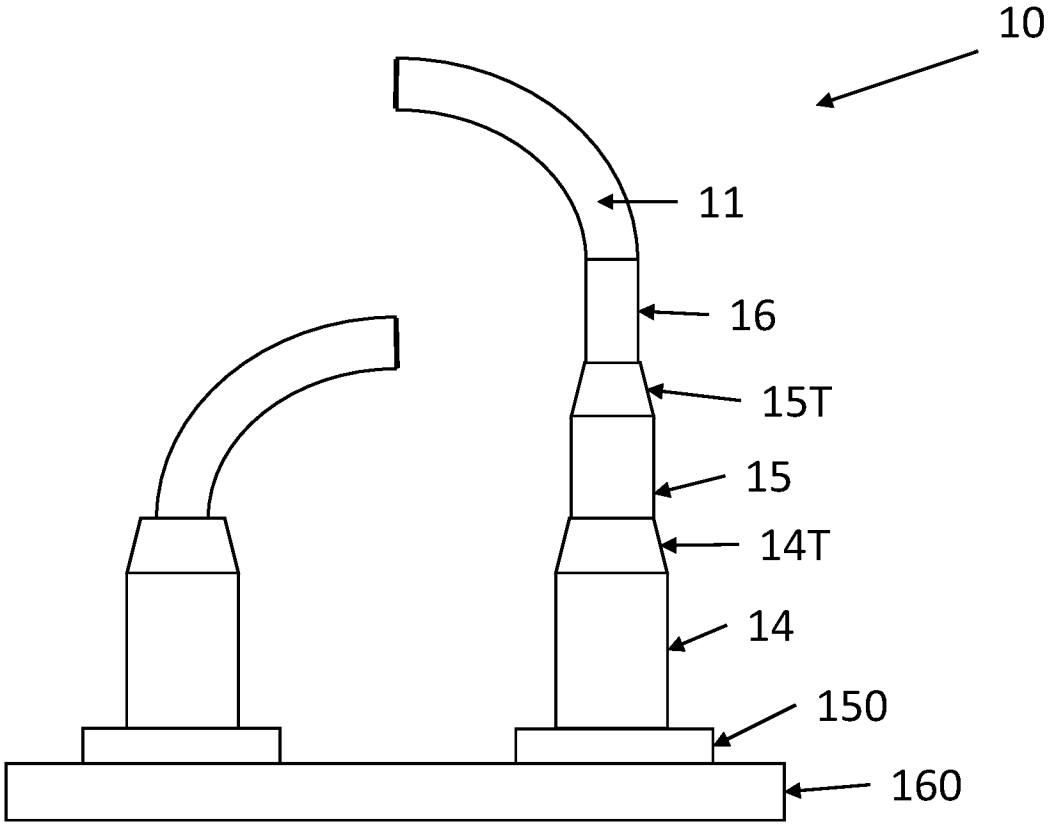
FIG. 12 is a front view of an adjustable ring in accordance with a first embodiment of the invention, wherein a half of the ring is at a raised position in relation to the other half, creating a gap for adding or removing sheet or sheet-like materials.

FIG. 12 shows the state of the adjustable ring 10 when a user adds or removes a sheet or sheet-like material. When a user wishes to add material into the adjustable ring, the user can raise either half of the adjustable ring (right half shown in FIG. 12) to create a gap between the distal ends 11*a* of the curved sections 11. If needed, the user can also lower the other half of the adjustable ring. Then the user can add or remove material through the gap. Once the user has finished adding or removing material, the user can adjust one or both halves of the curved section 11 so that the distal ends 11*b* of the curved sections 11 can lock onto each other, maintaining a closed upside-down U loop. The locking between the distal ends is the result of the interactions between the opposing surfaces, the friction built into the tubes/lips, other locking mechanisms or preferably, a combination of two or more of the above.

Figure 13:
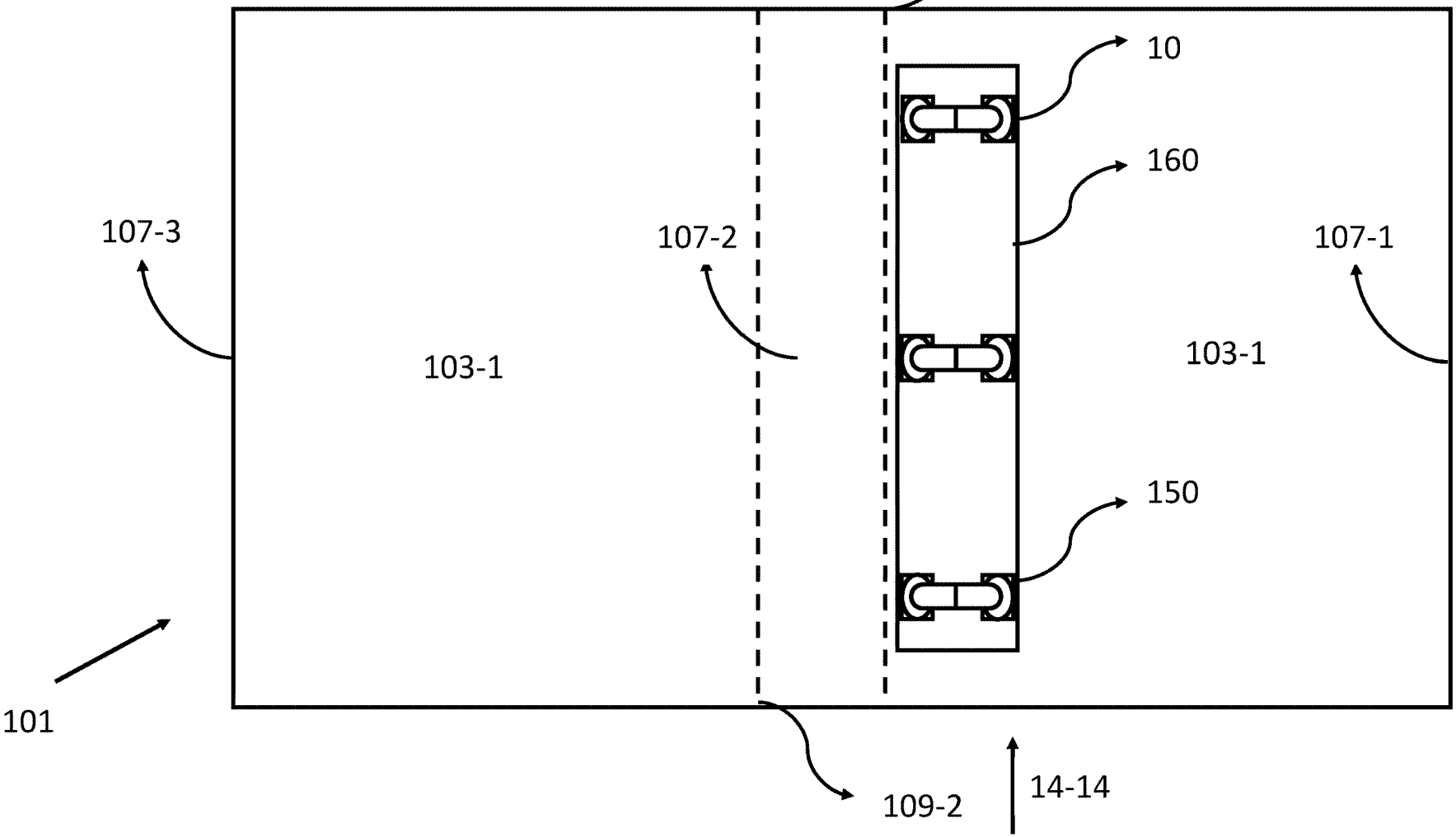
FIG. 13 is a top view of the ring binder using the adjustable ring in accordance with the first embodiment, wherein the binder is in a fully open state.
Figure 14:
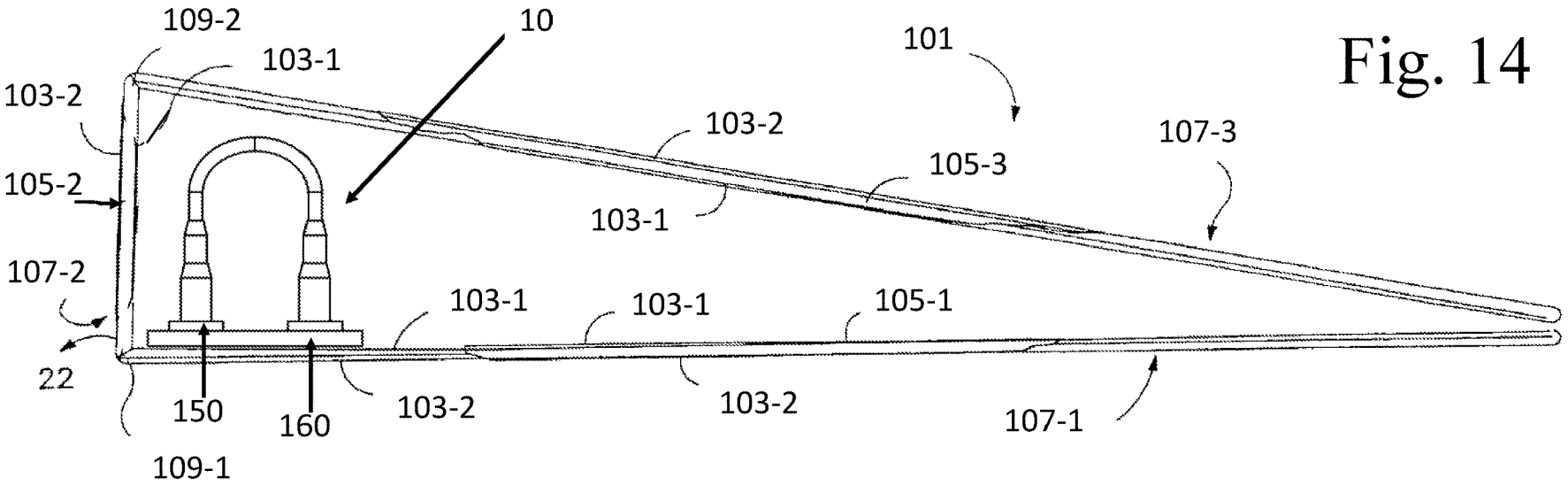
FIG. 14 is a side view of a binder along the direction of 14-14 in FIG. 13 after moving the binder covers into a fully closed state, with the rings in a fully extended state.

FIGS. 13-14 illustrate a binder incorporating the adjustable ring described in FIGS. 1-12. The binder 101 comprises a pair of superimposed sheets 103-1 and 103-2, and three rigid, spaced-apart, stiffener panels 105-1, 105-2 and 105-3. Stiffener panels 105-1 through 105-3, which are appropriately sized to provide support to the rear cover, spine and front cover, respectively, of binder 101, are sandwiched between sheets 103-1 and 103-2. Sheets 103-1 and 103-2 are heat-sealed to one another around their respective peripheries and on either side of panel 105-2 to define the rear cover 107-1, spine 107-2, and front cover 107-3, respectively, of binder 101, spine 107-2 being joined to rear cover 107-1 and to front cover 107-3 by hinge lines 109-1 and 109-2, respectively. One or more adjustable rings 10 (three shown in FIG. 13) are riveted or otherwise fastened to rear cover 107-1 through the base plate 150 and optionally, the ground plate 160. Spine 107-2 is free to pivot away from adjustable rings 10 in the direction indicated by arrow 22 to provide convenient access to adjustable rings 10. The width of spine 107-2 is great enough to enable covers 107-1 and 107-3 to clear the adjustable rings 10 at the ring's fully extended state.

Stiffener panels 105-1, 105-2 and 105-3 are preferably made from a rigid material, such as chipboard, cardboard, paperboard, plasticized polyvinyl chloride, low density polyethylene, thermoplastic rubber, ethylene-ethyl acrylate, ethylene-butylene copolymer, polybutylene and copolymers thereof, ethylene-propylene copolymers, chlorinated propylene, chlorinated polybutylene or mixtures of those, polyurethane elastomeric materials, polyester elastomeric materials, polyamide elastomeric materials, copolymers of isobutylene and isoprene, aluminum, steel, copper, iron, brass, and other materials of the like.

In other embodiments, the adjustable ring 10 of the invention is used in conjunction with a binder that is known in the art, such as any of the various embodiments of binders described in U.S. Pat. No. 5,607,246, which is incorporated in its entirety into the instant specification. Embodiments reflecting such use are considered embodiments of this invention. For example, a binder constructed according to the disclosure of U.S. Pat. No. 5,607,246 comprises (i) a front cover stiffener panel, said front cover stiffener panel preferably having an inside and outside sheet, and preferably being secured between said inside and said outside surface sheets, (ii) a rear cover stiffener panel, said rear cover stiffener panel being spaced apart from said front cover stiffener panel in opposing relation thereto and preferably having an inside and outside sheet, and preferably being secured between said inside and said outside surface sheets, (iii) one or more adjustable rings secured to said front cover stiffener panel and said rear cover stiffener panel, whereby said adjustable rings are in accordance with the first embodiment, (iv) a plurality of stiffener strips which are secured to each other, wherein said stiffener strips form a flexible spine which is connected to the front cover stiffener panel at one end, and connected to the rear cover stiffener panel at the opposing end, (v) whereby said front and said rear cover stiffener panels, and said stiffener strips cooperatively define a binder cover having front and rear covers interconnected by a flexible spine, said flexible spine being conformable about said one or more adjustable rings. The use of flexible backing is advantageous because it conforms to a larger or smaller range of material, in terms of thickness.

Although the invention has been described in conjunction with examples thereof, it will be appreciated by those skilled in the art, that additions, modifications, substitutions, and deletions may be made without departing from the spirit or scope of the invention as defined in the appended claims.

The invention claimed is:

1. An adjustable ring comprising:

a first telescoping tube assembly having a top and a bottom and being capable of moving from an extended state to a closed state, a second telescoping tube assembly having a top and a bottom and being capable of moving from an extended state to a closed state, a first curved section having a distal end and a proximal end, and a second curved section having a distal end and a proximal end, wherein the first curved section is placed on the top of the first telescoping tube assembly, and the proximal end of the first curved section is attached to the top of the first telescoping tube assembly, wherein the second curved section is placed on the top of the second telescoping tube assembly, and the proximal end of the second curved section is attached to the top of the second telescoping tube assembly, wherein the first and second telescoping tube assemblies are spaced apart from each other, and the first and second curved sections cooperate to form a releasable connection between their distal ends, wherein the first and second telescoping tube assemblies can each move from a fully closed state to a fully extended state, and wherein said first telescoping tube assembly and said second telescoping tube assembly each comprise an innermost tube and an outermost tube in a telescoping arrangement.

2. An adjustable ring comprising:

a first telescoping tube assembly having a top and a bottom and being capable of moving from an extended state to a closed state, a second telescoping tube assembly having a top and a bottom and being capable of moving from an extended state to a closed state, a first curved section having a distal end and a proximal end, and a second curved section having a distal end and a proximal end, wherein the first curved section is placed on the top of the first telescoping tube assembly, and the proximal end of the first curved section is attached to the top of the first telescoping tube assembly, wherein the second curved section is placed on the top of the second telescoping tube assembly, and the proximal end of the second curved section is attached to the top of the second telescoping tube assembly, wherein the first and second telescoping tube assemblies are spaced apart from each other, and the first and second curved sections cooperate to form a releasable connection between their distal ends, wherein the first and second telescoping tube assemblies can each move from a fully closed state to a fully extended state, and wherein said telescoping tube assembly and said second telescoping tube assembly each comprise an innermost tube, an intermediate tube, and an outermost tube in a telescoping arrangement.

3. An adjustable ring in accordance with claim 2, further comprising a first lip located at the bottom of, and attached to, said innermost tube, and a second lip located at the bottom of, and attached to, said intermediate tube, wherein said first lip defines the extent of movement for the innermost tube, and said second lip defines the extent of movement for the intermediate tube, when the telescoping tube assembly moves between the extended and closed states.

4. A binder comprising:

a front cover, a back cover, a spine, and one or more adjustable rings of claim 1, wherein the one or more adjustable rings are attached to the back cover.

5. A binder comprising:

a front cover, a back cover, a spine, and one or more adjustable rings of claim 2, wherein the one or more adjustable rings are attached to the back cover.

* * * * *